United States Patent [19]

Fort

[11] 3,967,674

[45] July 6, 1976

[54] SEALING STRUCTURE FOR A MACHINE FOR CENTRIFUGALLY CASTING PIPES AND MACHINE INCLUDING SAID STRUCTURE

[75] Inventor: Pierre Henri Marie Fort, Nancy, France

[73] Assignee: Pont-A-Mousson S.A., Nancy, France

[22] Filed: Feb. 10, 1975

[21] Appl. No.: 548,836

[30] Foreign Application Priority Data

Feb. 20, 1974 France ..... 74.05757

[52] U.S. Cl. ..... 164/297; 277/15; 277/34; 277/73; 277/22

[51] Int. Cl.[2] ..... B22D 13/02; F16J 15/00

[58] Field of Search ..... 277/34, 73, 32, 12, 277/15, 22; 164/298, 297

[56] References Cited

UNITED STATES PATENTS

| | | | |
|---|---|---|---|
| 2,153,674 | 4/1939 | Ommundson | 277/34 X |
| 2,876,492 | 3/1959 | Frieder et al. | 277/34 X |
| 2,906,565 | 9/1959 | Scherba | 277/34 X |
| 3,007,518 | 11/1961 | Simpson | 277/34 X |
| 3,589,435 | 6/1971 | Mougin | 164/297 |
| 3,651,859 | 3/1972 | Guminski | 164/298 |
| 3,718,178 | 2/1973 | Negre | 164/298 |

*Primary Examiner*—Samuel B. Rothberg
*Attorney, Agent, or Firm*—Sughrue, Rothwell, Mion, Zinn & Macpeak

[57] ABSTRACT

The sealing structure comprises an annular sealing member disposed in an annular recess in a ring fixed to the non-rotating casing of a centrifugal casting machine. The sealing member bears sealingly against an annular radial flange connected to rotate with the rotary mould of the machine. An elastically yieldable annular chamber is interposed between the inner end of the recess and the sealing member. A source of fluid under pressure is connected to the inside of the chamber to expand the latter and urge the sealing member against the flange.

2 Claims, 4 Drawing Figures

SEALING STRUCTURE FOR A MACHINE FOR CENTRIFUGALLY CASTING PIPES AND MACHINE INCLUDING SAID STRUCTURE

The present invention relates to a sealing structure for a centrifugal casting machine having a rotary mould in a liquid jacket inside a stationary casing of the machine, this sealing structure being of the type comprising a fixed annular sealing and rubbing member mounted on the casing of the machine and applied under adjustable pressure against a radial flange connected to rotate with the mould.

U.S. Pat. No. 3,756,307 describes in particular a sealing structure of this type whose sealing member is integral with a flexible wall closing an annular chamber, the other walls of the chamber being rigid and traversed by pipes connected to means for regulating the supply of fluid under pressure thereto.

An object of the present invention is to provide an improved sealing structure which operates under the same principle as that of the structure described in said patent application. This improved structure is particularly simple in construction since it requires practically no screws or bolts and can be made from commercially-available standard elements.

According to the invention, there is provided a sealing structure for a machine for centrifugally casting in a rotary mould in a liquid jacket inside a non-rotating casing of the machine, said structure being of the type comprising an annular fixed sealing and rubbing member mounted on the casing of the machine and applied at adjustable pressure against a radial flange connected to rotate with the mould, wherein the annular sealing member is mounted to slide in a direction parallel to the axis of the mould in an annular recess formed in a ring integral with the casing against an elastically-yielding chamber disposed in the bottom of said recess and connected by pipes to means for regulating the supply of fluid under pressure thereto.

Further features and advantages of the invention will be apparent from the ensuing description with reference to the accompanying drawings given solely by way of example and in which.

Figure 1:
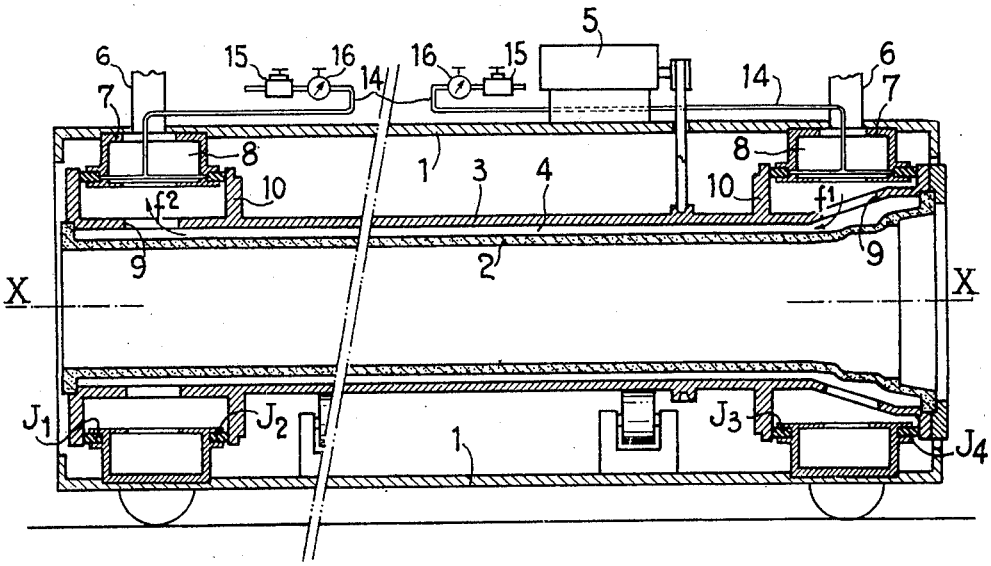
FIG. 1 is a diagrammatic sectional view of a machine for centrifugally casting pipes of the type having a "dry" casing and comprising four sealing structures according to the invention arranged in pairs at the ends of the casing.
Figure 2:
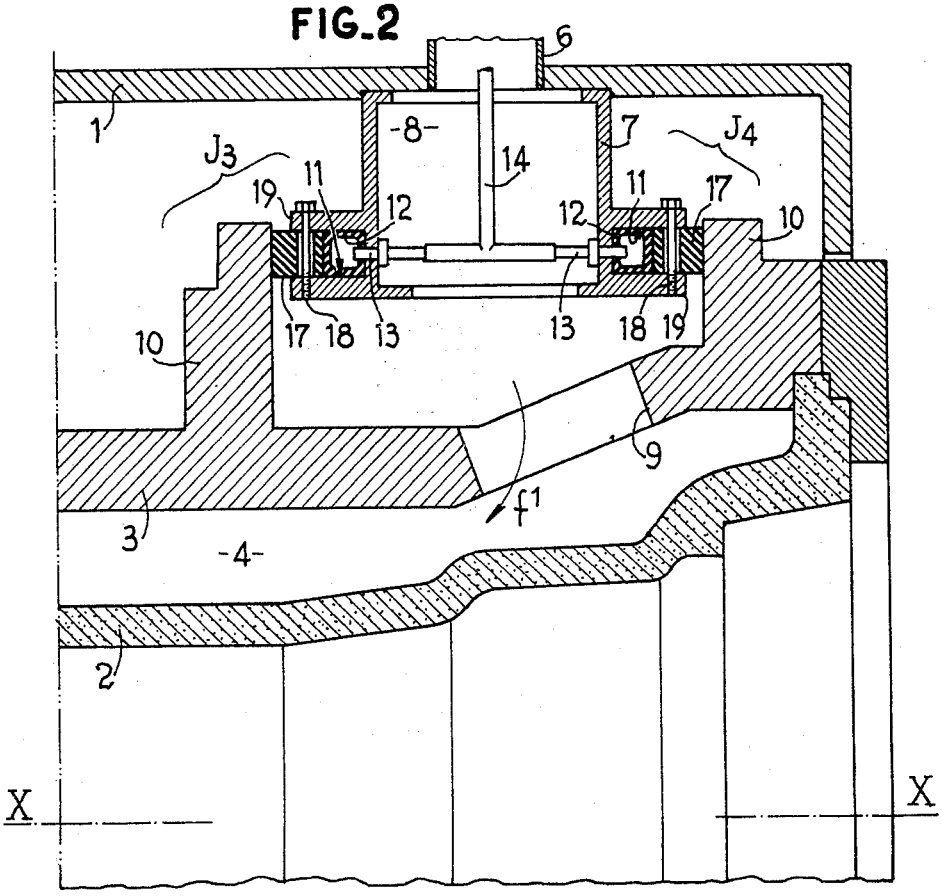
FIG. 2 is a detail view, to an enlarged scale, of one of the two pairs of sealing structures.

In the embodiment shown in FIGS. 1 and 2, the invention is applied to a machine for centrifugally casting metal pipes of the "dry" casing type. This machine comprises, in the known manner, a carriage which is movable in translation, this carriage comprising a casing 1 in which is rotatably mounted a centrifugal casting mould 2 having an axis X—X. This mould is surrounded by a coaxial jacket 3 which is connected to rotate therewith. This jacket 3 defines with the mould 2 an annular space 4 adapted to be filled with cooling water. The jacket 3 is part of a cooling water circuit for supplying cooling water to the outside of the mould, as will be explained hereinafter.

The mould 2 and the jacket 3 are driven in rotation by a motor 5. The cooling water supplied by an exterior supply circuit enters and leaves the ends of the carriage by way of pipes 6. The latter extend through the casing 1 and open into a corresponding one of two annular rings 7 secured to the casing 1 and coaxial with the jacket 3 and the mould 2, their cross-sectional shape being in the form of a U. Each ring 7 defines an annular chamber 8 which communicates with the annular space 4 by way of an opening 9 in the jacket 3 located in the region of the corresponding pipe 6.

Provided between each rigid transverse partition wall of each ring 7 and a radial flange 10 integral with the rotary jacket 3 is a sealing structure according to the invention. The machine therefore comprises four sealing structures J1, J2, J3 and J4. In this machine, the water jacket is restricted to the annular space 4 and the chambers 8. The aforementioned cooling water circuit comprises elements 2, 3, 6, 7, 9, 10, 17 and 19.

Each rigid partition wall has an annular groove 11 having an axis X—X in the inner end of which there is disposed an elastically-yieldable annular chamber 12 supplied with fluid under pressure. The fluid under pressure, which may be water or air, is supplied to the chamber 12 by way of a connection 13 which extends through the rigid partition wall of the ring 7 so as to connect the elastically-yieldable annular chamber 12 to a pipe 14 adpated to supply fluid under pressure to each sealing structure. There is one pipe 14 for the sealing structures J1 and J2 and another pipe 14 for the sealing structures J3 and J4 in the case of a "wet" casing, it will be seen hereinafter that a common pipe 14*a* can be employed for the two sealing structures J1 and J2). Outside the machine, each pipe has a pressure reducing valve 15 for regulating the pressure prevailing in the annular chamber 12 and a pressure gauge 16 for measuring this pressure.

The annular chamber 12 bears, on one hand, against the inner end of the annular groove 11 and, on the other, against a transverse end face of an annular sealing member 17 which has an axis X—X, the other end of the member 17 rubbing against the rotatable flange 10. The radial dimensions of the sealing member 17 correspond to those of the inner edges of the groove 11 apart from operational clearances. The member 17 can thus slide in the groove 11 in a direction parallel to the axis X—X. Preferably, this member 17 is interposed without clearance between the flange 10 of the jacket 3 and the elastically-yieldable chamber 12, its movement in the groove 11 being limited to the taking up of wear.

The sealing member 17 is of friction material, for example of a metal alloy containing copper (bronze) or not containing copper (friction iron) or of an organic material such as bakelized fabric. However, it is possible to envisage a wide range of other elastically-yieldable or rigid materials for this member 17.

Each sealing member 17 is prevented from rotating, for example by at least one radial pin 18 which extends through slots 19 in the cylindrical walls of the groove 11 which are parallel to the axis X—X and allows an axial movement of the member 17 for taking up wear. By way of a modification, the member 17 is prevented from rotating by adhesion to the transverse end face of the chamber 12 which is also adhered to the inner end of the groove 11.

The sealing structure just described operates in the following manner:

Water is supplied under pressure P by one of the pipes 6. This pressure P depends on the characteristics of the water supply plant and on the pressure drops in the cooling water circuit. It is, for example, of the order of 1.5 bars. The water flows in the direction of the arrow *f* 1 into a chamber 8 and into the annular space 4 where it constitutes a water jacket around the mould 2. It leaves the machine in the direction of arrow *f*2 by way of the other annular chamber 8 and the corresponding pipe 6.

In the region of each sealing structure J1 . . . J4, the water is in contact with the sealing member 17. Moreover, each elastically-yieldable chamber 12 is filled with fluid under pressure *p* which is regulated by the pressure reducing valve 15 and maintained at this pressure. The pressure *p*, regulated to a value lower than the pressure P, must be sufficient to ensure a fluidtight contact between the flange 10 and the sealing member 17. For example, the pressure *p* is of the order of 0.1 bar in respect of a pressure P of the order of 1.5 bars.

This difference between the pressure P and *p* can be explained by the fact that the sealing is not perfect between the flange 10 and the sealing member 17. A very small escape of water occurs between the rubbing surfaces of the flange 10 and the sealing member 17. The water also enters the interstices between the groove 11 and the sealing member 17 owing to the clearances for sliding contact. Consequently, a certain resultant hydraulic pressure *p*1 tends to separate the sealing member 17 from the flange 10. An opposing pressure is therefore necessary for applying the sealing member 17 frictionally against the flange 10. This is furnished by the pressure *p* of the fluid contained in the elastically-yieldable chamber 12.

If the speed of rotation of the mould 2 and jacket 3 is increased and the rate of casting of the liquid metal in the mould 2 is increased so as to increase production, the heating of the machine tends to increase and this may result in the drawback mentioned in the aforementioned French patent application No. 71.25,844. In order to compensate for the increase in the heating and avoid this drawback, the pressure P of the cooling water in the annular space 4 may be increased by ΔP. Thus, the pressure *p* of the fluid contained in each annular chamber 12 must be increased but in a much lower proportion than the increase ΔP in the pressure of the water jacket.

The required pressure *p* is also lower than that required under the same conditions by the sealing structure described in said French patent application, in which the flexible wall defining an annular chamber of adjustable pressure is subjected, on a part of its area, directly to the pressure P — which is not the case in respect of the sealing structure according to the present invention.

This advantage of only having to supply a low pressure *p* inside the chamber 12 facilitates the construction of its fluid supply circuits 14, 15 and 16. Moreover, as the resultant pressure *p*1 is low, the pressure exerted by the sealing member 17 against the flange 10 can be controlled with precision.

By reducing this pressure to a minimum when the mould 2 accelerates at the start of a normal pipe-casting cycle, it is possible to reduce the duration of the cycle, the effects of wear by friction between the member 17 and the flange 10 and the stresses undergone by the parts driven in rotation.

Moreover, the construction of each sealing structure J1, J2, J3, J4 is very simple since it is sufficient to place inside annular grooves 11 of small dimension and therefore of small overall size, a commercially-available elastically-yieldable annular chamber 12 and a sealing member 17 which is also easily obtainable owing to its simple shapes. Moreover, this construction has no screws or bolts.

As in the aforementioned U.S. Pat. No. 3,756,307, the allowed movement of the axis of rotation X—X of the mould and its jacket 3 relative to the fixed casing 1 supporting the sealing structure is very large. The rotating assembly (mould 2 and jacket 3) therefore need not be centered with precision.

Another advantage afforded by the sealing structure according to the invention relates to the means for fixing the sealing member 17. Indeed, in the case of a movement of the axis X—X, the sealing member 17 slides against the flange 10 and the low radial stresses resulting therefrom are easily absorbed by the rigid assembly formed by this member 17 in the groove 11, without deformation of the annular chamber 12.

The friction flanges 10 of the jacket 3 which were shown in FIGS. 1 and 2 as being in one piece with the jacket 3 may be attached thereto and constituted by simple washers or detachable rings which are rapidly assembled and disassembled.

On the other hand, the grooves 11 housing the annular chamber 12 for the fluid under pressure and the sealing member 17 are advantageously in one piece since they are not subject to wear.

Figure 3:
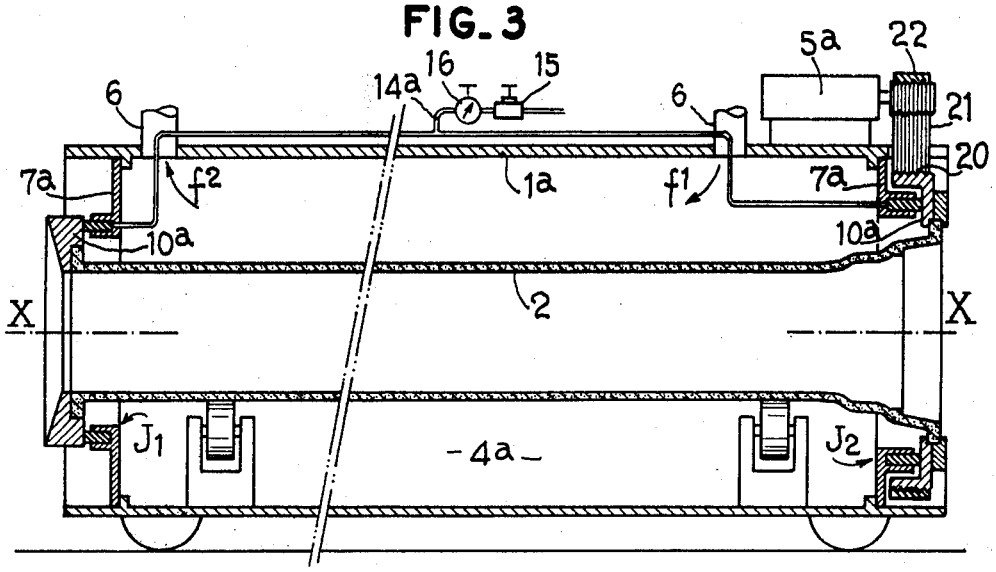
FIGS. 3 and 4 are views similar to FIGS. 1 and 2 in respect of a machine of the type having a "wet" casing and two sealing structures according to the invention.
Figure 4:
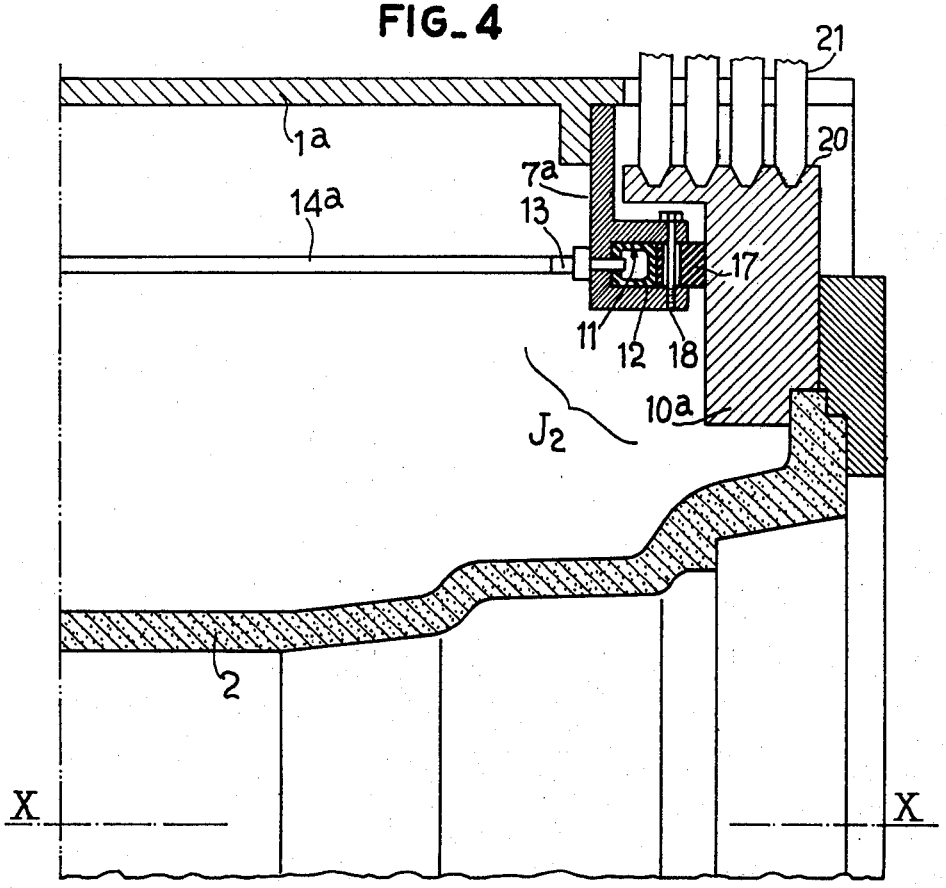

In the embodiment shown in FIGS. 3 and 4, the sealing structure according to the invention is applied to a centrifugal casting machine of the "wet" casing type. In these drawings, the same elements as in the foregoing embodiment carry the same references and similar elements carry the same references to which the index *a* is added. The mould 2 is surrounded by a water jacket 4*a* whose container is the fixed casing 1*a* of the machine. The water jacket 4*a* is part of a cooling water circuit for supplying cooling water to the outside of the mould. The cooling water enters and leaves the machine by way of pipes 6 which open directly onto the interior of the casing.

The mould 2 is driven in rotation by one of its end flanges 10*a* pertaining to the socket end of the pipe to be cast. This flange 10*a* is extended on its periphery by a pulley 20 having a plurality of grooves around which extend bolts 21. The latter extend around a small drive pulley 22 which is driven in rotation by a motor 5*a* mounted on the end of the casing 1*a*.

Applied against the flange 10*a* is a sealing-member 17 which is slidable in a groove 11 of a rigid transverse fixed partition wall 7*a* carried by the casing 1*a*. The partition wall 7*a* defines with the sealing structure, identical to that of the preceding embodiment, and with the flange 10*a*, the water jacket 4*a*.

At the other end of the mould adjacent the male end of the pipe to be cast, another flange 10*a* connected to rotate with the mould 2 rubs against a sealing member 17 carried by another rigid and fixed transverse partition wall 7*a* carried by the casing 1*a*. The aforementioned cooling water circuit comprises elements 1*a*, 2, 6, 7*a*, 10*a* and 17.

In this embodiment there are only two sealing structures J1 and J2 which are supplied with fluid under pressure by a common pipe 14*a*. The operation and the advantages are the same as those in the preceding embodiment of a "dry" casing machine.

Having now described my invention what I claim as new and desire to secure by Letters Patent is:

1. In a centrifugal casting machine comprising a rotary mould, a non-rotating casing surrounding the mould, means defining a cooling water circuit for containing water for cooling the mould, the water circuit comprising means defining a water jacket adjacent and surrounding the mould, an annular radial flange integral with the mould, a ring axially spaced from and coaxial with the flange and integral with the casing, the ring and flange being part of the means defining the water circuit; the improvement comprising an annular sealing structure axially interposed between the flange and the ring and consisting of an annular recess which is formed in the ring and defined by two coaxial annular walls radially spaced apart and a transversely extending inner end wall, an inflatable elastically yieldable annular tubular chamber located in the recess in adjoining relation to the inner end wall, means for inflating the annular chamber, a rigid annular sealing member having two coaxial cylindrical surfaces and a planar outer end surface terminating the cylindrical surfaces, the sealing member being mounted in the recess so that said cylindrical surfaces are respectively in close axially slidable contact with said two annular walls and the sealing member is in axially adjoining relation to the chamber, and means for precluding rotation of the sealing member relative to the ring, the sealing member having a portion which extends axially beyond the ring and is defined by a part of said cylindrical surfaces and said outer end surface, which outer end surface is in axially abutting sliding relation to the flange.

2. A sealing structure as claimed in claim 1, wherein said means precluding rotation comprises a pin extending radially through said sealing member and said ring.

* * * * *